US012303026B2

(12) United States Patent
Hurst

(10) Patent No.: US 12,303,026 B2
(45) Date of Patent: May 20, 2025

(54) PORTABLE CLOTHES HANGING ASSEMBLY

(71) Applicant: Steve Hurst, Greenwood, AR (US)

(72) Inventor: Steve Hurst, Greenwood, AR (US)

( * ) Notice: Subject to any disclaimer, the term of this patent is extended or adjusted under 35 U.S.C. 154(b) by 115 days.

(21) Appl. No.: 18/207,783

(22) Filed: Jun. 9, 2023

(65) Prior Publication Data

US 2024/0407546 A1 Dec. 12, 2024

(51) Int. Cl.
*A47B 61/06* (2006.01)
*A47G 25/06* (2006.01)

(52) U.S. Cl.
CPC ..... *A47B 61/06* (2013.01); *A47G 25/0664* (2013.01); *A47G 25/0685* (2013.01)

(58) Field of Classification Search
CPC . A47B 61/06; A47G 25/0664; A47G 25/0685
USPC ..... 206/279
See application file for complete search history.

(56) References Cited

U.S. PATENT DOCUMENTS

| | | | | |
|---|---|---|---|---|
| 1,894,485 | A | 1/1933 | Frankl | |
| 2,473,047 | A * | 6/1949 | Bershad | D06F 57/12 190/11 |
| 3,144,946 | A * | 8/1964 | Ellis | F16B 7/1418 211/206 |
| 6,264,047 | B1 | 7/2001 | Crumley | |
| D451,304 | S | 12/2001 | Felsenthal | |
| 9,565,932 | B2 | 2/2017 | Hirsch | |
| 9,820,542 | B2 | 11/2017 | McKelvey | |
| 9,877,557 | B2 | 1/2018 | Collins | |
| 10,271,644 | B1 * | 4/2019 | Johnson | A47B 61/02 |
| 10,337,136 | B1 * | 7/2019 | Fallah | A47B 43/00 |
| 10,383,415 | B1 * | 8/2019 | Graham | A45C 13/262 |
| 10,905,214 | B1 | 2/2021 | Wieclaw | |
| 2014/0262659 | A1 * | 9/2014 | Hirsch | A47G 25/0685 211/85.3 |
| 2016/0015190 | A1 * | 1/2016 | White | B62B 11/00 211/175 |
| 2016/0143406 | A1 * | 5/2016 | Collins | A45C 5/14 53/410 |
| 2017/0071302 | A1 * | 3/2017 | McKelvey | A45C 13/103 |

FOREIGN PATENT DOCUMENTS

| | | |
|---|---|---|
| CA | 2952144 | 6/2017 |

* cited by examiner

*Primary Examiner* — Don M Anderson
*Assistant Examiner* — Justin Caudill

(57) ABSTRACT

A portable clothes hanging assembly includes a pair of mounts that is each attachable to an outer wall of a storage tote. Each of the mounts has a pair of grips which defines a receiving space associated with a respective mount. A pair of risers is provided which comprise a lower section slidably attached to an upper section such that each of the pair of risers has an adjustable length. Each of the pair of risers is insertable into the receiving space defined in a respective one of the mounts thereby facilitating each of the pair of risers to be vertically oriented on the storage tote. A pole is insertable through respective ones of the plurality of attachment points in the upper section of each of the pair of risers. In this way the pole can support clothes hangers for hanging clothes stored in the storage tote.

11 Claims, 5 Drawing Sheets

PORTABLE CLOTHES HANGING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to clothes hanging devices and more particularly pertains to a new clothes hanging devices for hanging clothes that are stored in a storage tote. The device includes a storage tote, a pair of mounts that are attachable to the storage tote, a pair of risers that have an adjustable height and a pole. Each of the risers is attachable to a respective one of the mounts and the pole is extendable between the pair of risers for hanging clothes in the storage tote on the pole.

(2) Description of Related Art Including Information Disclosed Under 37 CFR 1.97 and 1.98

The prior art relates to clothes hanging devices including a variety of clothes handing devices that each includes a mechanical framework of arms that are collapsibly integrated into an article of luggage for hanging clothes. In no instance does the prior art disclose a clothes hanging device that includes a pair of mounts that are attachable to a storage tote, a pair of risers that are each attachable to the mounts and a pole that is extendable between the risers for hanging clothes stored in the storage tote.

BRIEF SUMMARY OF THE INVENTION

An embodiment of the disclosure meets the needs presented above by generally comprising a pair of mounts that is each attachable to an outer wall of a storage tote. Each of the mounts has a pair of grips which defines a receiving space associated with a respective mount. A pair of risers is provided which comprise a lower section slidably attached to an upper section such that each of the pair of risers has an adjustable length. Each of the pair of risers is insertable into the receiving space defined in a respective one of the mounts thereby facilitating each of the pair of risers to be vertically oriented on the storage tote. A pole is insertable through respective ones of the plurality of attachment points in the upper section of each of the pair of risers. In this way the pole can support clothes hangers for hanging clothes stored in the storage tote.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
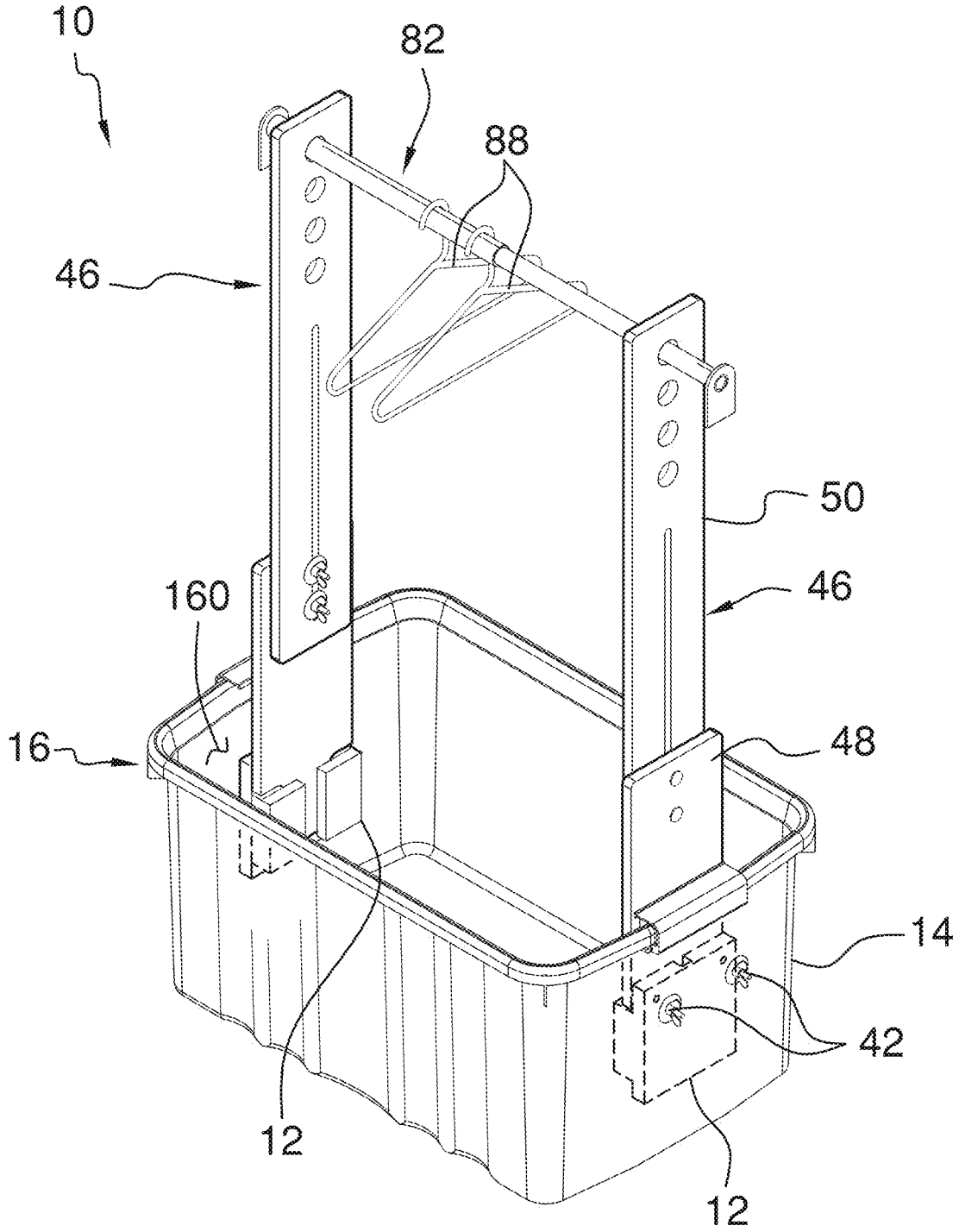
FIG. 1 is a front perspective view of a portable clothes hanging assembly according to an embodiment of the disclosure.
Figure 2:
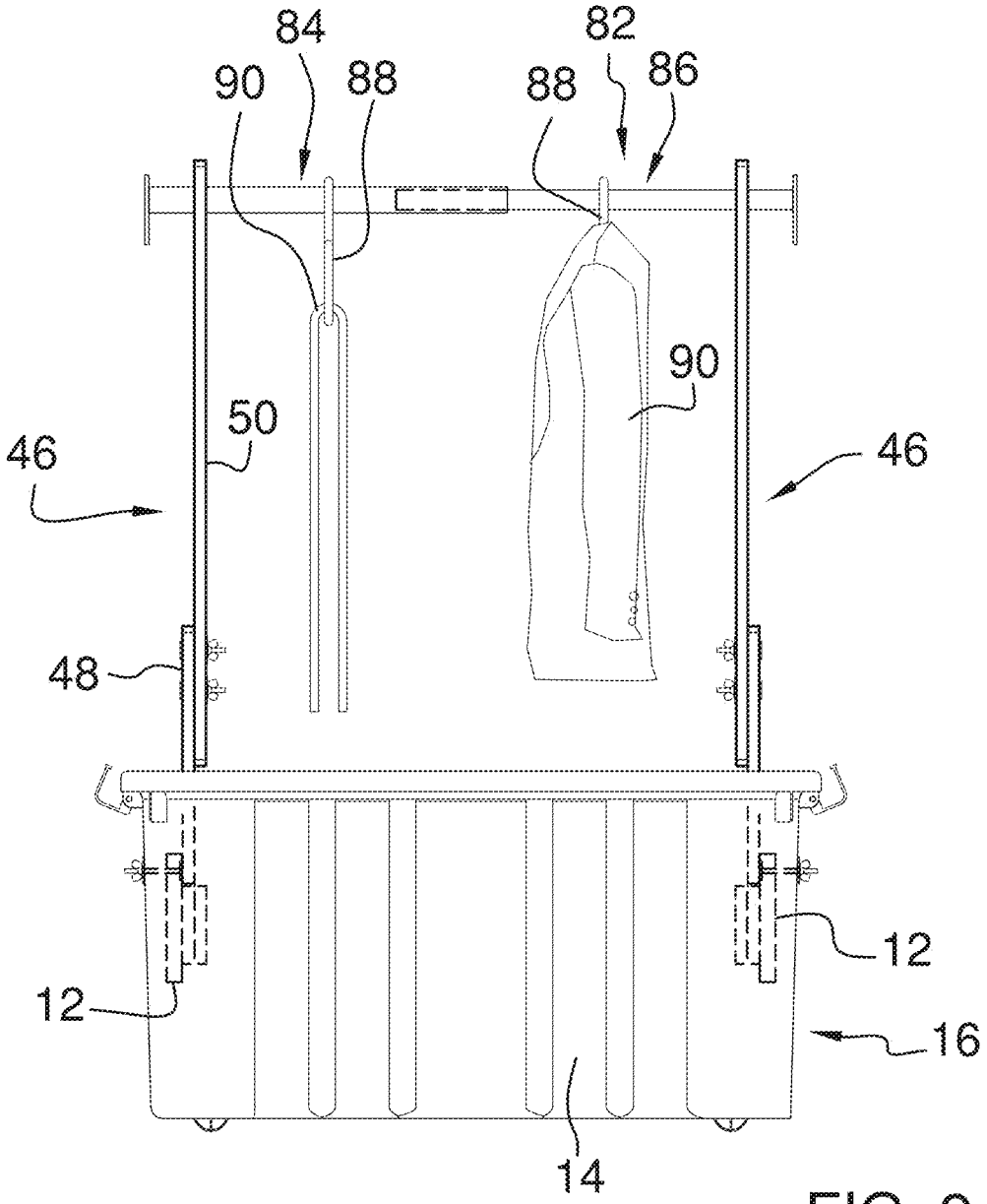
FIG. 2 is a front view of an embodiment of the disclosure.
Figure 3:
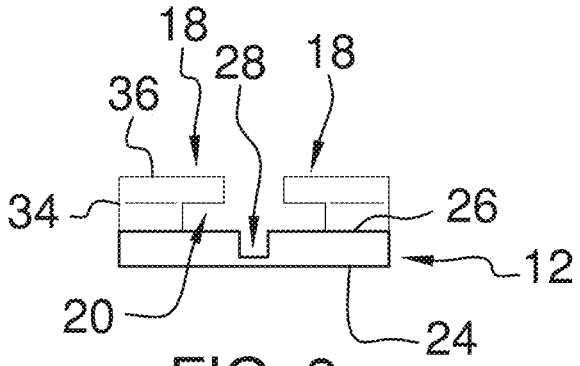
FIG. 3 is a top view of a mount of an embodiment of the disclosure.
Figure 4:
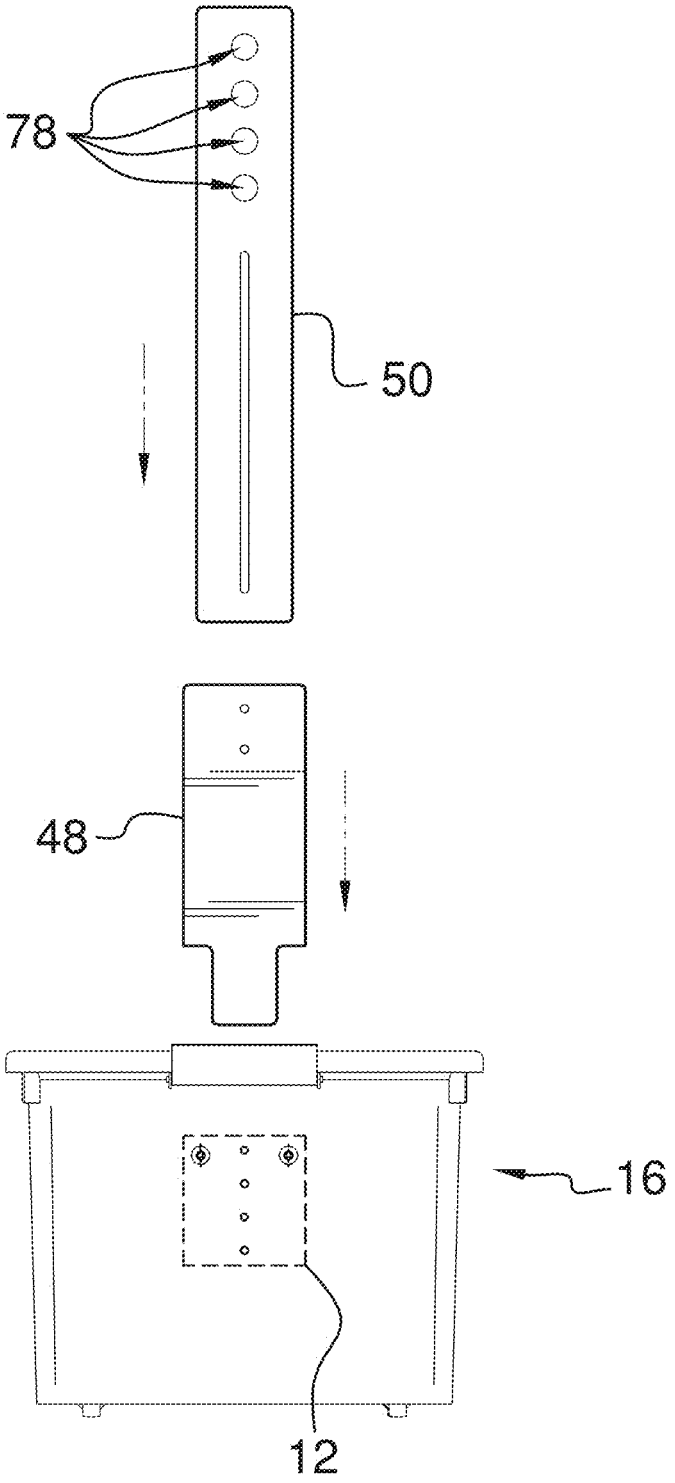
FIG. 4 is a left side exploded view of an embodiment of the disclosure.
Figure 5:
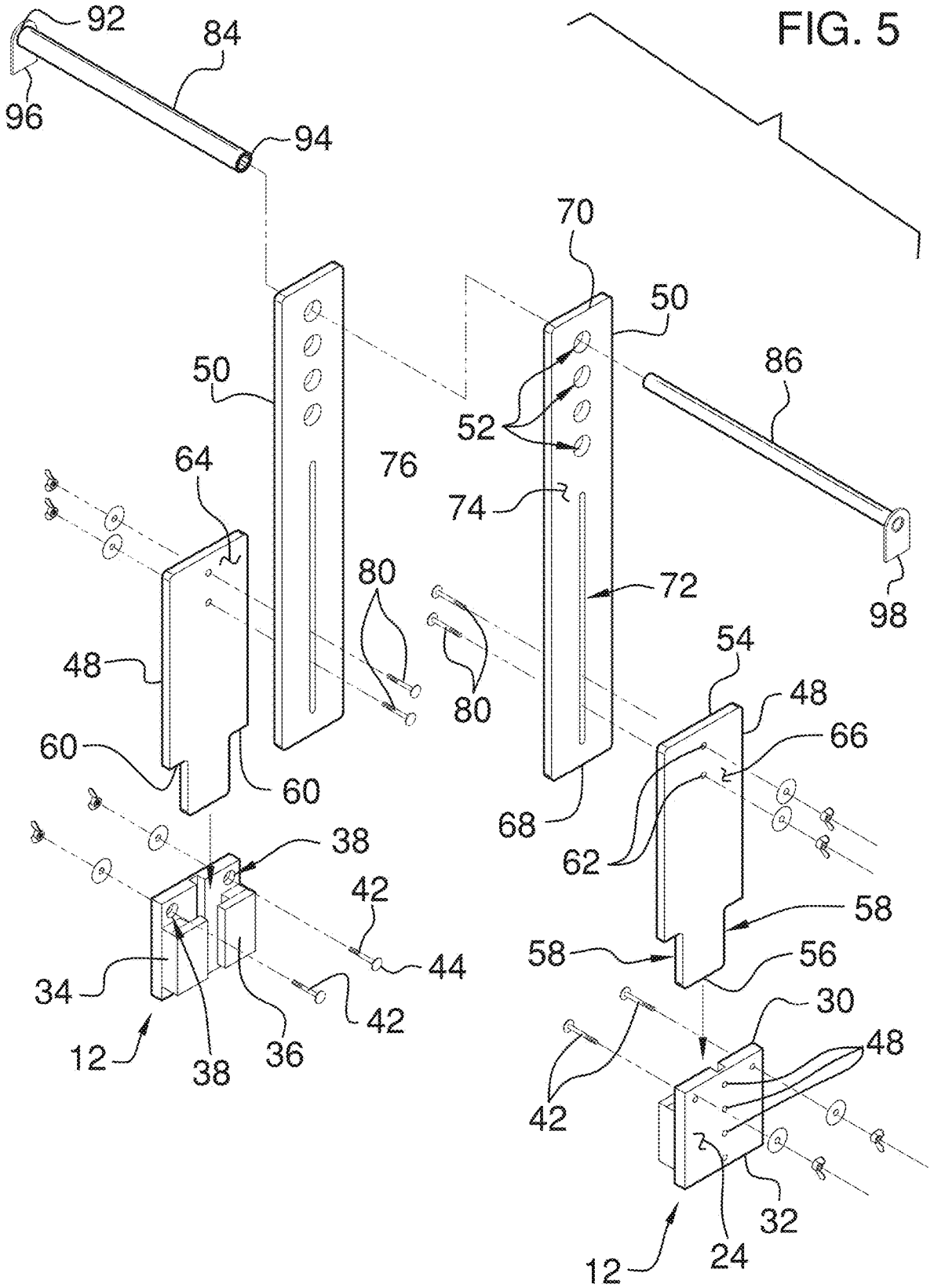
FIG. 5 is a perspective exploded view of an embodiment of the disclosure.
Figure 6:
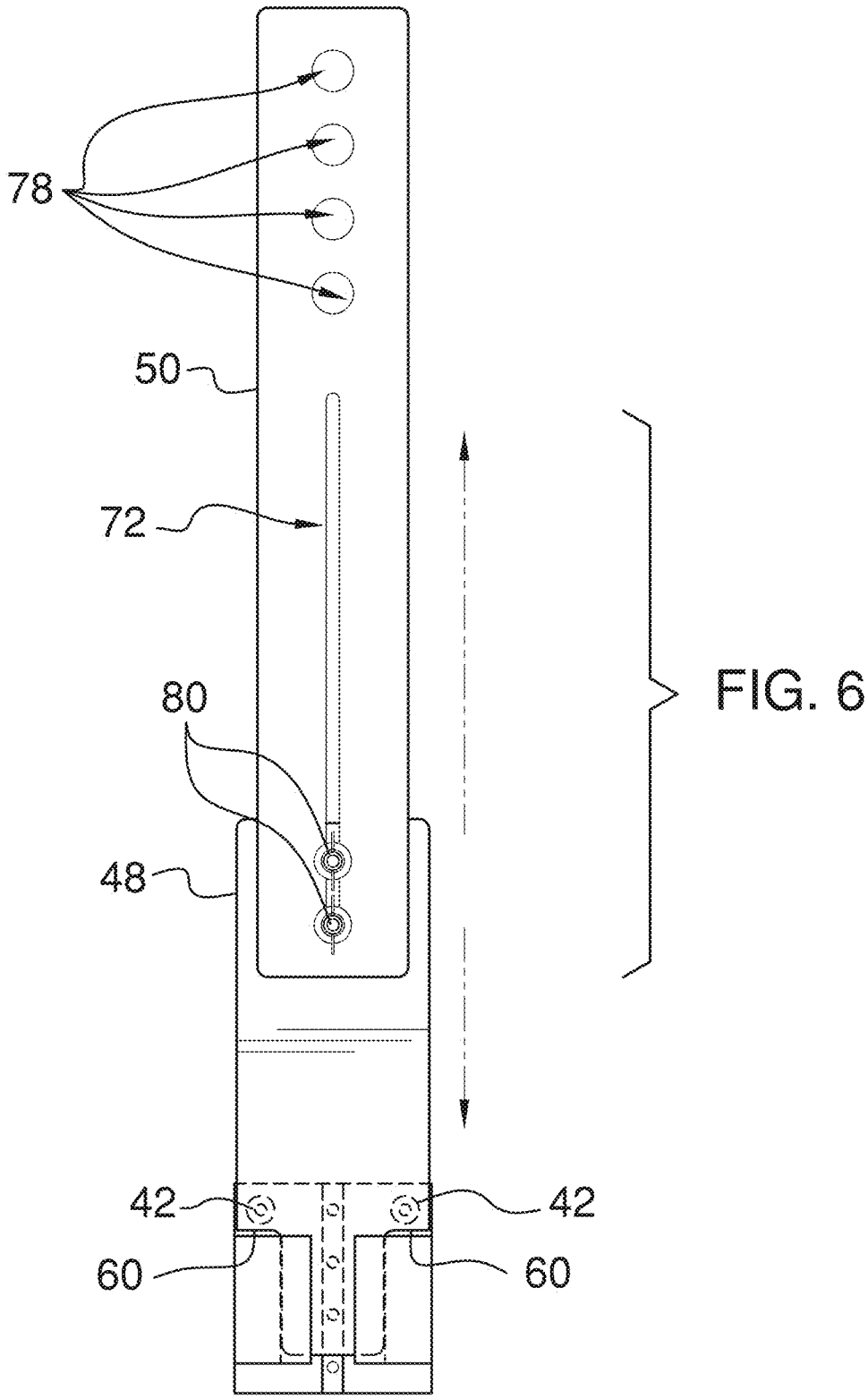
FIG. 6 is a left side view of a mount and a riser of an embodiment of the disclosure.

With reference now to the drawings, and in particular to FIGS. 1 through 6 thereof, a new clothes hanging device embodying the principles and concepts of an embodiment of the disclosure and generally designated by the reference numeral 10 will be described.

As best illustrated in FIGS. 1 through 6, the portable clothes hanging assembly 10 generally comprises a pair of mounts 12 that is each attachable to an outer wall 14 of a storage tote 16 having the pair of mounts 12 being positioned inside of the storage tote 16. Each of the mounts 12 has a pair of grips 18 which defines a receiving space 20 associated with a respective mount 12 and each of the mounts 12 has a rear surface 24 and a front surface 26. Each of the mounts 12 has a channel 28 that is recessed into the front surface 26; the channel 28 associated with a respective one of the mounts 12 extends through a top edge 30 and a bottom edge 32 of the respective mount 12 and the channel 28 is centered on the front surface 26. Each of the pair of grips 18 associated with each of the pair of mounts 12 comprises a leg 34 extending away from the front surface 26 and a foot 36 oriented parallel with the front surface 26. The leg 34 associated with each of the pair of grips 18 is positioned on opposite sides of the channel 28 having the foot 36 associated with each of the pair of grips 18 being directed toward each other to define the receiving space 20 between the foot 36 associated with each of the pair of grips 18 and the front surface 26.

Each of the mounts 12 has a pair of holes 38 each extending through the front surface 26 and the rear surface 24. Each of the holes 38 is positioned on opposite sides of the channel 28 with respect to each other. Furthermore, each of the holes 38 is positioned between the leg 34 of a respective one of the pair of grips 18 and the top edge 30 of a respective one of the mounts 12. Additionally, each of the holes 38 is chamfered with the front surface 26. As is most clearly shown in FIG. 5, each of the mounts 12 may have a series of holes 40 extending through the front surface 26 and the rear surface 24 and the series of holes 40 may be aligned with the channel 28.

A plurality of first fasteners 42 is provided and each of the first fasteners 42 is extendable through a respective one of the mounts 12 and the storage tote 16 for attaching the pair of mounts 12 to the storage tote 16. Each of the first fasteners 42 is extendable through a respective one of the holes 38 in the respective mount 12 and an outer wall 14 of the storage tote 16 such that a head 44 of each of the first fasteners 42 is recessed in the respective hole 38 having the head 44 of each of the first fasteners 42 lying flush with the front surface 26 of the respective mount 12. Additionally, each of the first fasteners 42 may comprise a wing nut, a bolt and a washer or other type of penetrating mechanical fastener that can be tightened and loosened without tools.

A pair of risers 46 is provided and each of the pair of risers 46 comprises a lower section 48 that is slidably attached to an upper section 50 such that each of the pair of risers 46 has an adjustable length. Each of the pair of risers 46 is insertable into the receiving space 20 defined in a respective one of the mounts 12. In this way each of the pair of risers 46 can be vertically oriented on the storage tote 16. Additionally, the upper section 50 of each of the pair of risers 46 has a plurality of attachment points 52.

The lower section 48 of each of the pair of risers 46 has a top end 54 and a bottom end 56 and the lower section 48 of each of the risers 46 is elongated between the top end 54 and the bottom end 56. The lower section 48 of each of the risers 46 has a pair of cutouts 58 extending from the bottom end 56 toward the top end 54 on opposite sides of the lower section 48. Furthermore, the pair of cutouts 58 define a pair of shoulders 60 that are spaced from the bottom end 56. The bottom end 56 is insertable into the receiving space 20 having each of the pair of shoulders 60 resting on the leg 34 associated with a respective one of the pair of grips 18. The lower section 48 of each of the pair of risers 46 has a pair of apertures 62 each extending through a forward surface 64 and a rear surface 66 of the lower section 48. The pair of apertures 62 are vertically distributed at a point located closer to the top end 54 than the bottom end 56 of the lower section 48.

The upper section 50 of each of the pair of risers 46 has a lower end 68 and an upper end 70; the upper section 50 is elongated between the lower end 68 and the upper end 70. The upper section 50 has a slot 72 extending through a front surface 74 and a back surface 76 of the upper section 50. The slot 72 is elongated to extend a substantial distance between the lower end 68 and the upper end 70 and the slot 72 is positioned closer to the lower end 68 than the upper end 70. The upper section 50 has a plurality of openings 78 each extending through the front surface 74 and the back surface 76 of the upper section 50 such that the plurality of openings 78 defines respective ones of the attachment points 52. Furthermore, the openings 78 are evenly spaced apart from each other and are distributed between the slot 72 and the upper end 70.

A plurality of second fasteners 80 is provided and each of the second fasteners 80 is extendable through the slot 72 in the upper section 50 of a respective one of the pair of risers 46 and a respective one of the apertures 62 in the lower section 48 of the respective riser 46. In this way the upper section 50 of the respective riser 46 is slidably attached to the lower section 48 of the respective riser 46. The upper section 50 is adjustable between a minimum height on the lower section 48 and a maximum height on the lower section 48. Additionally, each of the second fasteners 80 may comprise a wing nut, a bolt and a washer or other type of penetrating mechanical fastener that can be tightened or loosened without tools.

A pole 82 is provided which comprises a primary section 84 that slidably receives a secondary section 86 such that the pole 82 has a telescopically adjustable length. The pole 82 is insertable through respective ones of the plurality of attachment points 52 in the upper section 50 of each of the pair of risers 46. In this way the pole 82 can support clothes hangers 88 for hanging clothes 90 that are stored in the storage tote 16. The clothes 90 may be hunting clothes, for example, or other articles of clothing that are commonly stored for extended periods of time in the storage tote 16. Furthermore, the storage tote 16 may be a storage tote of any conventional design from any manufacturer.

Each of the primary section 84 and the secondary section 86 has a first end 92 and a second end 94; the second end 94 of the primary section 84 insertably receives the second end 94 of the secondary section 86. Each of the primary section 84 and the secondary section 86 is slidable through a respective one of the openings 78 in the upper section 50 of a respective one of the pair of risers 46. The primary section 84 has a first foot 96 extending downwardly from the first end 92 of the primary section 84 to inhibit the primary section 84 from being extended fully through the respective opening 78. The secondary section 86 has a second foot 98 extending downwardly from the first end 92 of the secondary section 86 to inhibit the secondary section 86 from being extended fully through the respective opening 78.

In use, holes 38 are drilled into the outer wall 14 of the storage tote 16 to facilitate the pair of mounts 12 to be attached to an inside surface 100 of the outer wall 14 with the first fasteners 42. The lower section 48 of each of the risers 46 is inserted into the receiving space 20 in a respective mount 12 and the upper section 50 of each of the risers 46 is adjusted to a desired height and the second fasteners 80 are tightened to retain the upper section 50 at the desired height. Each of the primary section 84 and the secondary section 86 of the pole 82 is extended through the respective openings 78 in the upper section 50 of the respective riser 46 and the second end 94 of the secondary section 86 is inserted into the second end 94 of the primary section 84. In this way the clothes 90 that are stored in the storage tote 16 can be hung on clothes hangers 88 on the pole 82. Thus, the clothes 90 can be arranged to be easily accessible on a hunting trip, for example, or other occasion that the clothes 90 stored in the storage tote 16 will be worn.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable clothes hanging assembly for facilitating clothes contained within a storage tote to be hung on clothes hangers, said assembly comprising:

a pair of mounts each being attachable to an outer wall of a storage tote having said pair of mounts being positioned inside of said storage tote, each of said mounts having a pair of grips which defines a receiving space associated with a respective mount;

a plurality of first fasteners, each of said first fasteners being extendable through a respective one of said mounts and said storage tote for attaching said pair of mounts to said storage tote;

a pair of risers, each of said pair of risers comprising a lower section being slidably attached to an upper section such that each of said pair of risers has an adjustable length, each of said pair of risers being insertable into said receiving space defined in a respective one of said mounts thereby facilitating each of said pair of risers to be vertically oriented on said storage tote, said upper section of each of said pair of risers having a plurality of attachment points; and a pole comprising a primary section slidably receiving a secondary section such that said pole has a telescopically adjustable length, said pole being insertable through respective ones of said plurality of attachment points in said upper section of each of said pair of risers thereby facilitating said pole to support clothes hangers for hanging clothes stored in said storage tote.

2. The assembly according to claim 1, wherein:

each of said mounts has a rear surface and a front surface;

each of said mounts has a channel being recessed into said front surface, said channel associated with a respective one of said mounts extending through a top edge and a bottom edge of said respective mount, said channel being centered on said front surface; and each grip of each of said pair of grips associated with each of said pair of mounts comprises a leg extending away from said front surface and a foot being oriented parallel with said front surface, said leg associated with each of said pair of grips being positioned on opposite sides of said channel having said foot associated with each of said pair of grips being directed toward each other to define said receiving space between said foot associated with each of said pair of grips and said front surface; and each of said mounts has a pair of holes each extending through said front surface and said rear surface, each of said holes being positioned on opposite sides of said channel with respect to each other, each of said holes being positioned between said leg of a respective one of said pair of grips and said top edge of a respective one of said mounts, each of said holes being chamfered with said front surface.

3. The assembly according to claim 2, wherein each of said first fasteners being extendable through a respective one of said holes in said respective mount and an outer wall of said storage tote such that a head of each of said first fasteners is recessed in said respective hole having said head of each of said first fasteners lying flush with said front surface of said respective mount.

4. The assembly according to claim 1, wherein;

said lower section of each of said pair of risers has a top end and a bottom end, said lower section of each of said risers being elongated between said top end and said bottom end; and said lower section of each of said risers has a pair of cutouts extending from said bottom end toward said top end on opposite sides of said lower section to define a pair of shoulders being spaced from said bottom end, said bottom end being insertable into said receiving space having each of said pair of shoulders resting on said leg associated with a respective one of said pair of grips.

5. The assembly according to claim 1, further comprising said lower section of each of said pair of risers having a pair of apertures each extending through a forward surface and a rear surface of said lower section, said pair of apertures being vertically distributed at a point located closer to a top end than a bottom end of said lower section.

6. The assembly according to claim 1, wherein:

said upper section of each of said pair of risers has a lower end and an upper end, said upper section being elongated between said lower end and said upper end;

said upper section has a slot extending through a front surface and a back surface of said upper section, said slot being elongated to extend a substantial distance between said lower end and said upper end, said slot being positioned closer to said lower end than said upper end; and said upper section has a plurality of openings each extending through said front surface and said back surface of said upper section such that said plurality of openings defines respective ones of said attachment points, said plurality of openings being evenly spaced apart from each other and being distributed between said slot and said upper end.

7. The assembly according to claim 1, wherein:

said upper section of each of said a pair of risers has a slot extending through said upper section;

said lower section of each of said pair of risers has a pair of apertures in said lower section; and a plurality of second fasteners, each of said second fasteners being extendable through said slot in said upper section of a respective one of said pair of risers and a respective one of said apertures in said lower section of said respective riser for slidably attaching said upper section of said respective riser to said lower section of said respective riser, said upper section being adjustable between a minimum height on said lower section and a maximum height on said lower section.

8. The assembly according to claim 6, wherein each of said primary section and said secondary section has a first end and a second end, said second end of said primary section insertably receiving said second end of said secondary section, each of said primary section and said secondary section being slidable through a respective one of said openings in said upper section of a respective one of said pair of risers.

9. The assembly according to claim 8, wherein said primary section has a first foot extending downwardly from said first end of said primary section to inhibit said primary section from being extended fully through said respective opening.

10. The assembly according to claim 9, wherein said secondary section having a second foot extending downwardly from said first end of said secondary section to inhibit said secondary section from being extended fully through said respective opening.

11. A portable clothes hanging assembly for facilitating clothes contained within a storage tote to be hung on clothes hangers, said assembly comprising:

a pair of mounts each being attachable to an outer wall of a storage tote having said pair of mounts being positioned inside of said storage tote, each of said mounts having a pair of grips which defines a receiving space associated with a respective mount, each of said mounts having a rear surface and a front surface, each of said mounts having a channel being recessed into said front surface, said channel associated with a respective one of said mounts extending through a top edge and a bottom edge of said respective mount, said channel being centered on said front surface, each grip of each of said pair of grips associated with each of said pair of mounts comprising a leg extending away from said front surface and a foot being oriented parallel with said front surface, said leg associated with each of said pair of grips being positioned on opposite sides of said channel having said foot associated with each of said pair of grips being directed toward each other to define said receiving space between said foot associated with each of said pair of grips and said front surface, each of said mounts having a pair of holes each extending through said front surface and said rear surface, each of said holes being positioned on opposite sides of said channel with respect to each other, each of said holes being positioned between said leg of a respective one of said pair of grips and said top edge of a respective one of said mounts, each of said holes being chamfered with said front surface;

a plurality of first fasteners, each of said first fasteners being extendable through a respective one of said mounts and said storage tote for attaching said pair of mounts to said storage tote, each of said first fasteners being extendable through a respective one of said holes in said respective mount and an outer wall of said storage tote such that a head of each of said first fasteners is recessed in said respective hole having said head of each of said first fasteners lying flush with said front surface of said respective mount;

a pair of risers, each of said pair of risers comprising a lower section being slidably attached to an upper section such that each of said pair of risers has an adjustable length, each of said pair of risers being insertable into said receiving space defined in a respective one of said mounts thereby facilitating each of said pair of risers to be vertically oriented on said storage tote, said upper section of each of said pair of risers having a plurality of attachment points;

wherein said lower section of each of said pair of risers has a top end and a bottom end, said lower section of each of said risers being elongated between said top end and said bottom end, said lower section of each of said risers having a pair of cutouts extending from said bottom end toward said top end on opposite sides of said lower section to define a pair of shoulders being spaced from said bottom end, said bottom end being insertable into said receiving space having each of said pair of shoulders resting on said leg associated with a respective one of said pair of grips, said lower section of each of said pair of risers having a pair of apertures each extending through a forward surface and a rear surface of said lower section, said pair of apertures being vertically distributed at a point located closer to said top end than said bottom end of said lower section;

wherein said upper section of each of said pair of risers having a lower end and an upper end, said upper section being elongated between said lower end and said upper end, said upper section having a slot extending through a front surface and a back surface of said upper section, said slot being elongated to extend a substantial distance between said lower end and said upper end, said slot being positioned closer to said lower end than said upper end, said upper section having a plurality of openings each extending through said front surface and said back surface of said upper section such that said plurality of openings defines respective ones of said attachment points, said plurality of openings being evenly spaced apart from each other and being distributed between said slot and said upper end;

a plurality of second fasteners, each of said second fasteners being extendable through said slot in said upper section of a respective one of said pair of risers and a respective one of said apertures in said lower section of said respective riser for slidably attaching said upper section of said respective riser to said lower section of said respective riser, said upper section being adjustable between a minimum height on said lower section and a maximum height on said lower section; and a pole comprising a primary section slidably receiving a secondary section such that said pole has a telescopically adjustable length, said pole being insertable through respective ones of said plurality of attachment points in said upper section of each of said pair of risers thereby facilitating said pole to support clothes hangers for hanging clothes stored in said storage tote, each of said primary section and said secondary section having a first end and a second end, said second end of said primary section insertably receiving said second end of said secondary section, each of said primary section and said secondary section being slidable through a respective one of said openings in said upper section of a respective one of said pair of risers, said primary section having a first foot extending downwardly from said first end of said primary section to inhibit said primary section from being extended fully through said respective opening, said secondary section having a second foot extending downwardly from said first end of said secondary section to inhibit said secondary section from being extended fully through said respective opening.

* * * * *